US005297733A

United States Patent [19]

Burks et al.

[11] Patent Number: 5,297,733

[45] Date of Patent: Mar. 29, 1994

[54] FLAME SPRAY GUN

[75] Inventors: Leonard R. Burks; Mark T. Dobek, both of Big Spring, Tex.

[73] Assignee: Plastic Flamecoat Systems, Inc., League City, Tex.

[21] Appl. No.: 70,283

[22] Filed: Jun. 2, 1993

Related U.S. Application Data

[63] Continuation-in-part of Ser. No. 760,866, Sep. 16, 1991.

[51] Int. Cl.[5] ..... B05B 1/24; B05B 7/02; B05B 7/06

[52] U.S. Cl. ..... 239/85; 239/79; 239/346; 239/422; 239/424; 239/428; 239/526

[58] Field of Search ..... 239/79, 80, 85, 340, 239/346, 525, 526, 422, 423, 424, 424.5, 428

[56] References Cited

U.S. PATENT DOCUMENTS

| | | | |
|---|---|---|---|
| 2,125,764 | 8/1938 | Benoit | 91/12.2 |
| 2,404,590 | 7/1946 | Nantz | 128/27.4 |
| 2,436,335 | 2/1948 | Simonsen | 91/12.2 |
| 2,554,259 | 3/1951 | Duccini et al. | 91/12.2 |
| 2,594,222 | 4/1952 | Sandora et al. | 299/86 |
| 2,643,955 | 6/1953 | Powers et al. | 117/21 |
| 2,794,677 | 6/1957 | Collardin et al. | 299/28.8 |
| 2,804,337 | 8/1957 | Marantz | 299/28.7 |
| 2,829,006 | 4/1958 | Johansson | 239/526 |
| 2,961,335 | 11/1960 | Shepard | 117/46 |
| 3,073,528 | 1/1963 | Wilson et al. | 239/79 |
| 3,171,599 | 3/1965 | Rotolico | 239/85 |
| 3,404,838 | 10/1968 | Hawk | 239/79 |
| 3,441,215 | 4/1969 | Cape | 239/85 |
| 3,460,764 | 8/1969 | Wallis | 239/422 |
| 3,565,345 | 2/1971 | Moltzan | 239/422 |
| 4,317,540 | 3/1982 | Simm et al. | 239/85 |
| 4,628,644 | 12/1986 | Somers | 239/526 |
| 4,632,309 | 12/1986 | Reimer | 239/8 |
| 4,759,505 | 7/1988 | Delaplace et al. | 239/85 |
| 4,835,022 | 5/1989 | Huhne | 427/423 |
| 4,865,252 | 9/1989 | Rotolico et al. | 239/8 |
| 4,934,595 | 4/1990 | Reimer | 239/8 |
| 4,971,251 | 11/1990 | Dobrick et al. | 239/346 |
| 5,207,382 | 5/1993 | Simm et al. | 239/79 |

*Primary Examiner*—Andres Kashnikow
*Assistant Examiner*—Christopher G. Trainor
*Attorney, Agent, or Firm*—Ross, Howison, Clapp & Korn

[57] ABSTRACT

A flame spray gun comprising a trigger-operated valve for selectively controlling the flow of conveying air to an eductor disposed in the powder flow nozzle, thereby providing the operator with substantially instantaneous control over the powder feed rate through the gun.

3 Claims, 2 Drawing Sheets

FLAME SPRAY GUN

CROSS REFERENCE TO RELATED APPLICATION

This application is a continuation in part of copending application Ser. No. 07/760,866, filed Sep. 16, 1991, still pending.

BACKGROUND OF THE INVENTION

1. Field of the Invention

This invention relates to applicator devices useful for flame spraying heat fusible, powdered plastic or metal coatings onto a substrate, and more particularly, to a flame spray gun comprising means disposed within the gun for instantaneously controlling the powder feed rate through the gun.

2. Description of Related Art

Many flame spray guns, spray nozzles, torches and the like have previously been disclosed in prior art patents such as U.S. Pat. Nos. 2,125,764; 2,404,590; 2,436,335; 2,544,259; 2,594,222; 2,643,955; 2,794,677; 2,804,337; 2,961,335; 3,073,528; 3,171,599; 3,441,215; 3,460,764; 3,565,345; 4,632,309; 4,835,022; 4,865,252; and 4,934,595.

Some flame spray systems that are useful for coating objects with a thin layer of heat fusible plastic or metal powder employ a hopper having an eductor nozzle disposed at or near its base. Compressed air or another pressurized gas is directed through the eductor nozzle, where it entrains powder drawn from the hopper, and conveys the powder through a flow line to an applicator device such as a flame spray gun.

In various prior art devices, the powder feed rate has been controlled in different ways. U.S. Pat. No. 4,934,595, for example, discloses a pilot valve that is mounted on the hopper body and controls the flow of compressed air through the eductor. The pilot valve is operated by a switch disposed on the flame spray gun. A disadvantage of this system is that once the pilot valve is closed by operating the switch on the applicator device, the flow of pressurized air through the eductor is blocked, and powder is permitted to settle in the flow line between the hopper and the gun. This can in turn contribute to undesirable powder surging when the pressurized air supply to the eductor is subsequently reestablished.

In copending application Ser. No. 07/760,866, filed Sep. 16, 1991, an improved flame spray system is disclosed that utilizes a powder control mechanism comprising a valve disposed in the base of the hopper above the eductor. The valve is operated by a switch disposed on the applicator device, and controls the powder flow into the eductor area independently of the compressed air flow through the eductor. This control system enables the operator to turn off the powder feed and purge the flow line of powder prior to turning off the air flow through the eductor. Although this system avoids the powder surging problems associated with the device disclosed in U.S. Pat. No. 4,934,595, it still suffers the disadvantage of a delay between the time the powder valve is closed and the time that the last powder in the flow line clears the flame spray gun. The delay between operation of the switch controlling the powder valve and the cessation of powder flow through the flame spray gun is proportional to the length of the flow line.

Other prior art devices such as those disclosed, for example, in U.S. Pat. No. 3,441,215 and in FIGS. 3 and 4 of 4,835,022 utilize an integrated powder delivery system in which a powder hopper is attached to the top of the applicator device. Powder is gravity fed into the applicator device through a hand operated valve. A principal disadvantage of these systems is that the powder hopper must be located above and adjacent to the applicator device.

A powder feed system and applicator device are therefore needed that comprise a remote powder storage container and means for providing real time control of powder flow and the powder feed rate through the applicator device. Such apparatus is disclosed herein.

SUMMARY OF THE INVENTION

According to one embodiment of the invention, a flame spray applicator device for heat fusible powdered materials is provided that comprises a body having a pistol grip handle and a powder nozzle containing an eductor through which pressurized conveying air passes and draws fluidized powder from a remote source to be heated by a combusting mixture of air or other oxygen-containing gas and fuel gas as the powder is discharged from the distal end of the device. A trigger-operated valve is preferably disposed in the flow path of the pressurized air upstream of the eductor so that the operator can continuously control the supply of pressurized air to the eductor and thereby effectively and substantially instantaneously control the rate at which powder is discharged from the powder nozzle of the device.

According to one preferred embodiment of the invention, a flame spray gun is provided that comprises a body having a pistol grip handle, a powder nozzle disposed in a cylindrical bore within the body, an eductor disposed in a cylindrical bore within the powder nozzle, a first connector means for providing pressurized air to the body from a remote source, an air flow path between the pressurized air connection and the inlet end of the eductor, a trigger-operated valve controlling air flow through the air flow path, and a second connector means for providing fluidized powder from a remote powder source to the cylindrical bore of the body at a point adjacent to the outlet end of the eductor at a relatively lower pressure than that of the pressurized air. According to a particularly preferred embodiment of the invention, another manually adjustable valve is provided in the air flow path between the trigger-operated valve and the eductor for use in regulating the air flow rate to the eductor independently of the trigger-operated valve. According to another particularly preferred embodiment of the invention, a second pressurized air flow path is provided between the first connector means and an annular space around the powder nozzle in the cylindrical bore of the body, and another manually adjustable valve is provided in the air flow path between the first connector means and the annular space.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
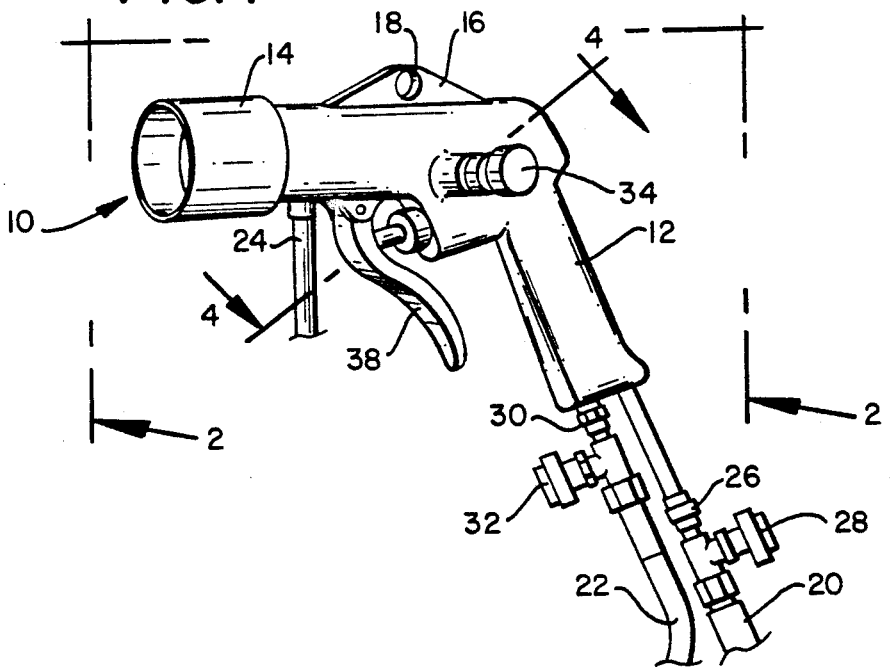
FIG. 1 is a perspective view of a preferred embodiment of the flame spray gun of the invention.

Referring to FIGS. 1-6, flame spray gun 10 of the invention preferably comprises metal body 12 having a pistol grip handle, and a metal hood 14 that threadedly engages the forwardly extending end of body 12. Upwardly extending hanger plate 16 of body 12 comprises aperture 18, and provides a convenient means for hanging flame spray gun 10 from a support hook or the like when not in use. Alternatively, it will be apparent that a ring or hook can be attached to body 12 in place of hanger plate 16 for use in hanging flame spray gun 10 from a rack, belt, or the like. Body 12 preferably comprises a centrally disposed axial bore 44 that communicates with fluid passageways 54, 56 and a forwardly facing annulus 55 that communicates with fluid passageway 58. Diaphragm 50 is preferably located between body 12 and hood 14. Fuel gas supply line 20 having valve 28 disposed at or near its end is releasably joined to body 12 by fitting 26, and communicates with passageway 58 of body 12. A preferred fuel gas for use in flame spray gun 10 is propane. Pressurized combustion gas supply line 22 having valve 32 disposed at or near its end is releasably joined to body 12 by fitting 30, and communicates with passageway 56 of body 12. A preferred pressurized combustion gas for use in flame spray gun 10 is compressed air. Fluidized powder supply line 24 is releasably joined to body 12 by fitting 40, and communicates with passageway 72 of body 12. Although not shown in the drawings, it will be apparent that a conventional hand operated valve can also be provided at or near the end of powder supply line 24, although such a valve may not be needed for reasons discussed below in relation to the operation of the invention.

A preferred powder for use in flame spray gun 10 comprises a major portion of a cryogenically ground ethylene-methacrylic acid (EMAA) polymer. It will also be understood to those of ordinary skill in the art upon reading this disclosure that powders comprising other thermoplastic polymers, mixtures of thermoplastic and thermosetting polymers, finely divided metals, finely divided ceramics, glass beads, and the like, can also be satisfactorily applied using an applicator device as disclosed herein. Where the powder to be applied comprises a major portion of a thermoplastic resin, the powder should be heated to at least its softening point by the flame at the outlet end of flame spray gun 10. Metal and ceramic powders are generally applied as an overcoat to a thermoplastic layer with the apparatus of the invention, and need only be heated sufficiently upon exiting flame spray gun 10 that the particles will soften the preexisting plastic surface to facilitate bonding between the particles and the surface. Where the plastic surface is already softened to some extent by preheating with flame spray gun 10, very minor heating of the metal or ceramic particles may be needed in order to effectuate the desired degree of bonding.

Figures 2, 2A:
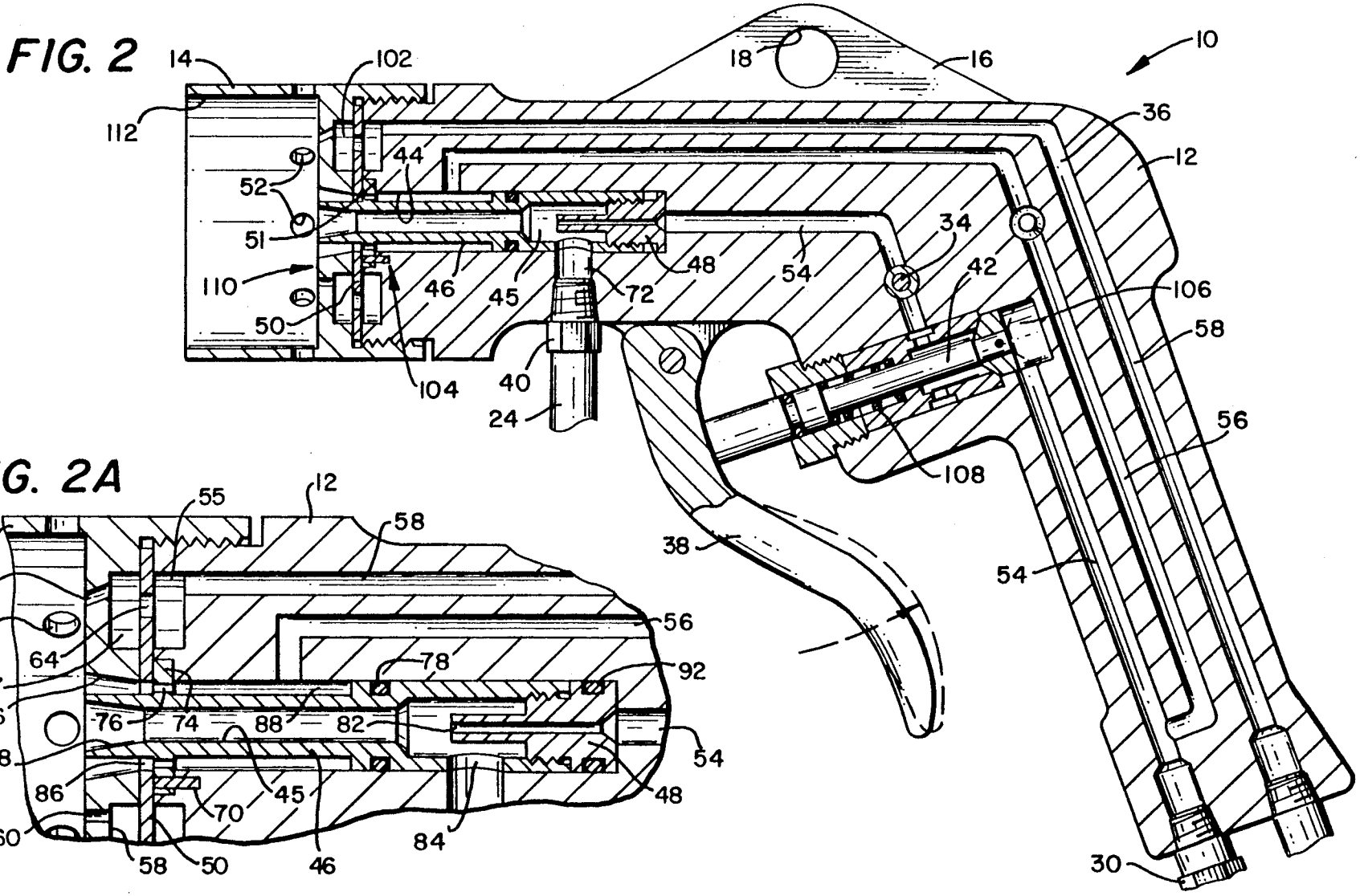
FIG. 2 is cross-sectional side elevation view taken along line 2—2 of FIG. 1.
FIG. 2A is an enlarged view of the powder nozzle and eductor portions of the flame spray gun of FIG. 2.

Powder nozzle 46 is disposed inside bore 44, and eductor nozzle 48 is preferably threaded into the upstream end of stepped internal bore 45 of powder nozzle 46. As shown in FIG. 2A, eductor nozzle 48 preferably comprises centrally disposed axial bore 82 having a smaller diameter than the diameter of passageway 54.

Valves 34, 42 are adapted to control flow through passageway 54 and valve 36 is adapted to control flow through passageway 56. Passageway 56 preferably provides fluid communication between a point upstream of valve 42 in passageway 54 and annulus 88 around powder nozzle 46. Valves 34, 36 are preferably operated by adjustment knobs 98, 100, respectively, and valve 42 in preferably operated by trigger 38 to facilitate continuous and substantially instantaneous control by the operator.

Powder nozzle 46 is preferably held in place when hood 14 is threaded onto body 12 by flange 74 that seats in recess 51 of body 12. One function of diaphragm 50 is to serve as a sealing gasket between the facing and otherwise contacting portions of hood 14 and body 12. Diaphragm 50 is preferably made of an elastomeric material such as rubber, and most preferably, is made of NEOPRENE® rubber having a durometer of about 90. It is understood, however, that other materials such as soft metals or synthetic compositions may also be suitable for use as diaphragm 50 in some applications.

Figure 5:
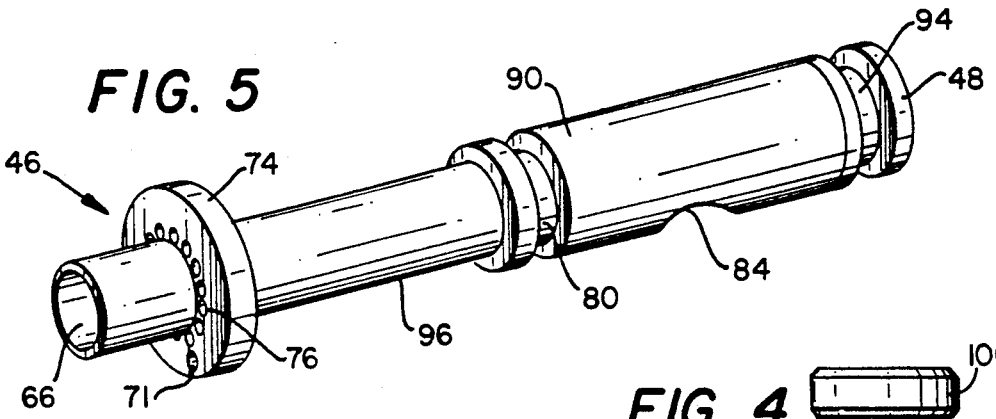
FIG. 5 is an enlarged front perspective view of the powder nozzle of the invention.
Figure 4:
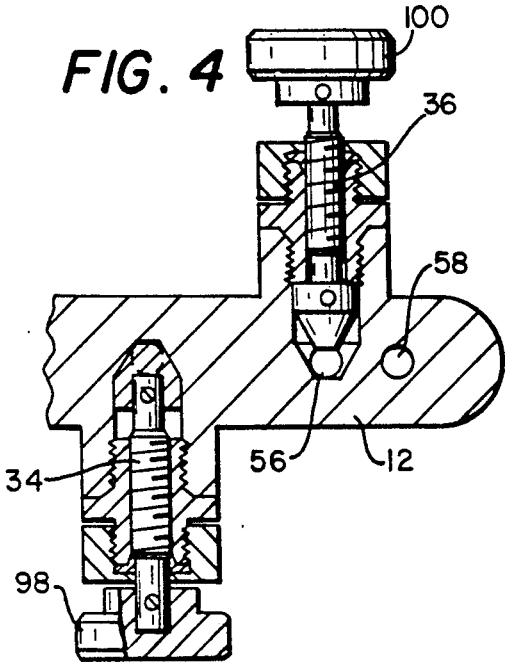
FIG. 4 is cross-sectional plan view taken along line 4—4 of FIG. 1.

Referring to FIGS. 2, 2A and 5, powder nozzle 46 preferably further comprises thicker-walled body section 90 having outwardly facing annular groove 80 adapted to receive O-ring 78. Similarly, eductor nozzle 48 preferably comprises a thicker walled body section having outwardly facing annular groove 94 adapted to receive O-ring 92. Passageway 72 of body 12 communicates with stepped cylindrical bore 45 of powder nozzle 46 through orifice 84 in body section 90. Recess 96 between flange 74 and body section 90 cooperates with bore 44 of body 12 to define annular space 88 which communicates with passageway 56. Circumferentially spaced orifices 76 in flange 74 permit pressurized combustion gas entering annulus 88 from passageway 56 to flow past flange 74 and outwardly through centrally disposed bore 66 of hood 14.

Figure 3:
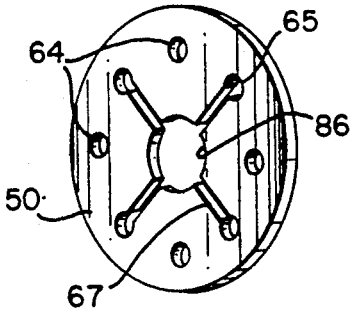
FIG. 3 is a perspective view of the sealing diaphragm of the invention.

Referring to FIGS. 2 and 2A, hood 14 preferably further comprises inwardly facing annulus 57 (defined by recess 58) that is coaxially aligned with annulus 55 (defined by recess 102) of body 12. Referring to FIGS. 2A and 3, a portion of diaphragm 50 partially partitions annulus 57 from annulus 55, and thereby helps distribute the fuel gas flow evenly around annulus 55. An array of circumferentially spaced orifices 64, 65 are preferably provided to allow the fuel gas to flow past diaphragm 50 and into annulus 57. Although it will be appreciated that the number, diameter and spacing of orifices 64, 65 can be changed depending upon factors such as, for example, the pressure, temperature, desired flow rate and type of fuel gas being used, eight orifices spaced about 45 degrees apart are depicted in FIG. 3.

Referring to FIG. 3, according to a particularly preferred embodiment of the invention, diaphragm 50 comprises discrete orifices 64 that are alternated with orifices 65 having slots 67 extending radially inward from orifices 65 to centrally disposed aperture 86. Slots 67, while not required to operate flame spray gun 10, are believed to improve performance by directing a minor portion of the flow of compressed air passing axially through annulus 88 radially outward into orifices 65. These radially directed flows of compressed air are believed to assist in balancing the flow of fuel gas into annulus 57 and also to assist in mixing the fuel gas with combustion gas. Aperture 86 preferably has an inside diameter greater than the outside diameter of powder nozzle 46 to permit axial flow through annulus 88. Most preferably, the diameter of aperture 86 is about equal to the diameter of bore 44.

Bore 66 of hood 14 and surface 68 near the outlet end of stepped internal bore 45 of powder nozzle 46 are preferably tapered so as to provide a slightly increasing bore diameter in the flow direction. This slight flaring near the outlet of flame spray gun 10 is also believed to enhance the mixing of combustion air flowing through annulus 88 with fuel gas flowing through circumferentially spaced orifices 60, 62 in hood 14 and to enhance the coverage pattern of the powder particles discharged through powder nozzle 46.

Similarly, in the preferred embodiment depicted in FIGS. 2 and 2A, circumferentially spaced, axially directed ports 60 are alternated with inwardly directed oblique ports 62 to provide converging flow paths for fuel gas discharged from annulus 57 through hood 14. Circumferentially spaced, radially extending orifices 52 are preferably provided in the forwardly extending, open section of hood 14 to allow ambient air to be drawn radially inward as powder, pressurized air and fuel gas are discharged through centrally disposed bore 66 and ports 60, 62 of hood 14. This flow of ambient air adjacent to interiorly facing sidewall 112 of hood 14 is believed to assist in keeping hood 14 cool during use of flame spray gun 10.

Powder nozzle 46 and body 12 preferably further comprise cooperative means for placing powder nozzle 46 in a predetermined rotational alignment inside bore 44 so that orifice 84 of powder nozzle is aligned with passageway 72 of body 12. One preferred means for achieving this rotational alignment is pin 70 that extends through orifice 71 in flange 74 and into a cooperatively aligned cylindrical bore 102 in body 12.

Referring to FIGS. 1–6, flame spray gun 10 is operated by first connecting lines 20, 22 and 24 to suitable sources of fuel gas, pressurized gas (preferably compressed air), and powder, respectively. Although the fuel gas and compressed air are supplied to flame spray gun 10 at pressures significantly greater than atmospheric pressure, the powder supplied to flame spray gun 10 through line 24 is preferably at about atmospheric pressure as it approaches the gun in line 24. According to one preferred embodiment of the invention, the powder is supplied from a fluidized bed powder source entrained in flow of gas, preferably air, at a pressure sufficiently greater than atmospheric to offset the pressure drop that occurs due to friction within line 24. This pressure drop can vary for a particular powder depending upon the length and diameter of line 24.

When flame spray gun 10 is used for the first time, valves 28, 32, 34, 36 and 42 are preferably closed, and lines 20, 22, 24 are connected to flame spray gun 10 by means of fittings 26, 30 and 40, respectively. Valve 36 is then opened, permitting compressed air to flow upward into passageways 54, 56 until it is blocked by valves 42, 36, respectively. Valve 36 is opened sufficiently to establish a desired rate of flow of combustion air into annulus 88. Valve 28 is then opened to allow fuel gas to flow through passageway 58 into annulus 55, through orifices 64, 65 into annulus 57, and through ports 60, 62 into the open end of hood 14. If diaphragm 50 contains slot 67, some of the compressed air, which is preferably at a slightly higher pressure than the fuel gas, passes axially through annulus 88, through orifices 76 in flange 74 of powder nozzle 46, and radially outward through slots 67 into orifices 65 of diaphragm 50, where it is mixed with the fuel gas prior to being discharged through ports 60, 62 in hood 14. The remainder of the compressed air flowing through passageway 56 and annulus 88 is discharged through tapered bore 66 of hood 14 as combustion air. As the fuel gas and combustion air are discharged under pressure from face 110 of hood 14, they mix to form a combustible mixture that is lighted to create a flame. The flame is then adjusted by operating valves 28, 36 as needed.

Once the flame is ignited, flame spray gun 10 is desirably moved back and forth across the substrate to be coated in order to preheat and drive moisture off of the surface. (This assumes that the surface has already been cleaned and prepared for the application of a flame sprayed coating as disclosed in the prior art.) Once the surface is ready, powder is injected into the flame by opening valve 34 and depressing trigger 38 to open valve 42 against the pressure of spring 108 from the position shown in FIG. 2 to position 106 shown in phantom outline. Opening valves 34, 42 allows compressed air to flow upwardly through passageway 54, into eductor nozzle 48 and outwardly through bore 82 of eductor nozzle 48 as shown in FIG. 2A. Because bore 82 has a restricted diameter, a significant pressure drop is experienced at the point where the compressed air exits bore 82 into bore 45 of powder nozzle 46. This pressure drop creates a vacuum or "negative pressure" over orifice 84, causing powder to be drawn up into bore 45 out of line 24. The powder is then entrained in the flow of conveying air, which is discharged past tapered surface 68 of powder nozzle 46 and through the open end of hood 14. As the flow of powder and conveying air exits hood 14, the powder particles are heated by the surrounding flame prior to being blown onto the surface being coated.

A significant feature of the apparatus of the invention is the provision of trigger operated valve 42 in combination with inductor nozzle 48 and powder supply orifice 82 in powder nozzle 46 so that the operator can continuously control the powder feed rate by controlling the flow of conveying air through passageway 54. Once valve 34 is initially opened to the extent desired for a particular powder, compressed air pressure and application, subsequent control of the powder feed rate is achieved by varying the extent to which trigger 38 is depressed. By simply releasing trigger 38, the operator can almost instantaneously halt the flow of powder through powder nozzle 46. Because no powder remains in flame spray gun 10, plugging is not a problem and there are no slugs of powder when powder flow is reestablished by again depressing trigger 38. If a greater powder flow rate is desired that can be achieved by fully opening valve 34 and by fully depressing trigger 38, one can increase the regulated pressure of the compressed air supplied through line 22.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. Apparatus for applying a flame-sprayed coating of a powdered material to a substrate, the apparatus comprising a flame spray having a body, a powder nozzle disposed inside the body, an eductor nozzle extending the powder nozzle and having an inlet and outlet, a fluidized powder supply port within the powder nozzle adjacent to the eductor nozzle outlet, a first passageway flow of pressurized conveying gas to the eductor nozzle inlet, a valve disposed inside the body for selectively controlling the flow of conveying gas the first passageway, an annulus around the powder nozzle, a second providing fluid communication between the annulus and the first passageway at a point in first passageway that is upstream of the trigger-operated valve, the second passageway supplying a flow of pressurized combustion gas to the annulus, and a valve the flow of combustion gas through the second passageway, wherein the powder nozzle comprises a radially extending flange blocking the a plurality of orifices in the flange permitting the pressurized combustion gas to flow the flange through the annulus.

2. The apparatus of claim 1 wherein the flame spray gun comprises a hood, means for attaching the hood to the body, means for establishing a flow of pressurized fuel gas through the body and hood, a diaphragm disposed between the hood and the body, an array of orifices diaphragm for balancing the flow of fuel gas from the body to the hood, aperture in the diaphragm having the powder nozzle inserted therethrough defining a portion of the annulus, and radially extending slots in the diaphragm providing fluid communication between at least one of the orifices and aperture.

3. Apparatus for applying a flame-sprayed coating of a powdered material to a substrate, the apparatus comprising a flame spray having a body, a powder nozzle disposed inside the body, an eductor nozzle extending the powder nozzle and having an inlet and outlet, a fluidized powder supply port the powder nozzle adjacent to the eductor nozzle outlet, a first passageway flow of pressurized conveying gas to the eductor nozzle inlet, and a valve disposed inside the body for selectively controlling the flow of conveying gas the first passageway, wherein the body of the flame spray gun further comprises a passageway for supplying fluidized powder to the powder port of the powder nozzle and means for maintaining a predetermined rotational between the powder nozzle and the body.

* * * * *

UNITED STATES PATENT AND TRADEMARK OFFICE

CERTIFICATE OF CORRECTION

PATENT NO. : 5,297,733

DATED : MARCH 29, 1994

INVENTOR(S) : BURKS ET AL.

It is certified that error appears in the above-identified patent and that said Letters Patent is hereby corrected as shown below:

At Column 7, line 3: (first occurrence)
after a insert --heat-fusible--
At Column 7, line 4:
after spray insert --gun--
At Column 7, line 5:
after extending insert --inside--
At column 7, line 8:
after passageway insert --supplying a--

At column 7, line 10:
after a insert --trigger -operated --.
At column 7, line 11:
after gas insert --through--
At column 7, line 12:
after second insert --passageway--
At column 7, line 14:
after in insert --the--
At column 7, line 17:
after valve insert --controlling--

UNITED STATES PATENT AND TRADEMARK OFFICE

CERTIFICATE OF CORRECTION

PATENT NO. : 5,297,733

DATED : MARCH 29, 1994

INVENTOR(S) : BURKS ET AL

It is certified that error appears in the above-identified patent and that said Letters Patent is hereby corrected as shown below:

At column 7, line 20:
after the (first) insert --annulus, and--
At column 7, line 21:
after flow insert --past--
At column 7, line 24:
after gun insert --further--
At column 8, line 3:
after orifices insert --in the--
At column 8, line 4:
after hood, insert --an--
At column 8, line 5:
after therethrough insert --and--
At column 8, line 10: (first occurrence)
after a insert --heat-fusible,--
At column 8, line 11:
after spray insert --gun--
At column 8, line 12:
after extending insert --inside--
At column 8, line 14:
after port insert --within--

UNITED STATES PATENT AND TRADEMARK OFFICE

CERTIFICATE OF CORRECTION

PATENT NO. : 5,297,733

DATED : MARCH 29, 1994

INVENTOR(S) : BURKS ET AL.

It is certified that error appears in the above-identified patent and that said Letters Patent is hereby corrected as shown below:

At column 8, line 15:
after passageway insert --supplying a--
At column 8, line 17:
after a insert --trigger-operated--
At column 8, line 18:
after gas insert --through--
At column 8, line 21: ( 2nd occurrence)
after powder insert --supply--
At column 8, line 22:
after rotational insert --alignment--

Signed and Sealed this

Sixth Day of June, 1995

*Attest:*

*Attesting Officer*

Bruce Lehman

BRUCE LEHMAN

*Commissioner of Patents and Trademarks*